US005551980A

United States Patent [19]

Turnbo

[11] Patent Number: 5,551,980

[45] Date of Patent: Sep. 3, 1996

[54] HOLDER FOR SUPPORTING DOORS TO BE TREATED

[76] Inventor: James R. Turnbo, 2143 W. 12th, Apt. 9, Eugene, Oreg. 97402

[21] Appl. No.: 371,863

[22] Filed: Jan. 12, 1995

[51] Int. Cl.[6] ..... B05C 13/00

[52] U.S. Cl. ..... 118/500; 248/125.2; 269/905

[58] Field of Search ..... 118/500; 248/125, 248/171, 125.2; 269/41, 905; 198/378, 379

[56] References Cited

U.S. PATENT DOCUMENTS

| | | | |
|---|---|---|---|
| 1,581,960 | 4/1926 | King | 269/905 |
| 2,372,111 | 3/1945 | Norberg | 248/125 |
| 2,882,666 | 4/1959 | Cochrane | 248/125 |
| 3,288,412 | 11/1966 | Murphy | 248/125 |
| 3,942,779 | 3/1976 | Bourdo | 269/41 |
| 4,609,093 | 9/1986 | Taketani et al. | 198/378 |
| 4,978,132 | 12/1990 | Wilson et al. | 269/905 |
| 5,090,648 | 2/1992 | Wood, IV | 248/125 |
| 5,164,011 | 11/1992 | Ray | 118/500 |

*Primary Examiner*—Laura Edwards
*Attorney, Agent, or Firm*—Eugene M. Eckelman

[57] ABSTRACT

An upright support member includes at least one laterally extending arm at the upper end thereof. This arm supports upright rails having adjustable hanger brackets thereon. The hanger brackets support door support plates capable of having doors to be treated mounted thereon by hinges whereby the door can be treated on both sides by hinged movement of the door. The door mounting plate can have screw holes that match hinge screw holes whereby to provide substitute hinges for supporting the doors thereon. By means of such structure, a process of painting a series of doors is available wherein the doors are disconnected from their hinges, the hinges being left on the cabinets. Door matching hinges are used and according to the system care does not have to be taken for painting the hinges.

12 Claims, 2 Drawing Sheets

HOLDER FOR SUPPORTING DOORS TO BE TREATED

BACKGROUND OF THE INVENTION

This invention relates to a novel holder for supporting doors to be treated.

Various methods of refinishing doors, such as the painting of cabinet doors or passageway doors are followed. For example, the doors are left in place which means that the painter has to be very careful to avoid the hinges and other cabinet parts. Also, in this case, it is difficult to reach all the edges of the door. In another method, the doors are removed for convenience in painting but this means that the door must be leaned up against something or laid flat with the result that one side must be allowed to dry before painting the other side. This applies as well to new doors to be mounted.

Devices have heretofore been provided in an effort to speed up painting or treating of doors. For example, U.S. Pat. Nos. 5,164,011 and 5,090,648 are concerned with an upright standard with right angle top and bottom arms that support a door vertically by upper and lower pins that penetrate the top and bottom edges of the door whereby the door can be rotated to paint or treat both sides without waiting for one side to dry. U.S. Pat. No. 1,581,960 shows a somewhat similar structure wherein portions of the support structure penetrate the door. In all of these patents, damage results to the doors which requires repair of the holes.

SUMMARY OF THE INVENTION

It is an object of the present invention to provide improvements on existing structures of the type that hold doors to be painted.

Another object is to provide a holder of the type described that utilizes hinges for support of the door whereby to conveniently allow the door to be swung for painting both sides and edges and at the same time assuring a positive support of the door.

Another important objective of the invention comprises the provision of hinge screw holes in a door support plate which match the pattern of hinge screw holes in a door to be treated, and utilizing substitute hinge means having pre-drilled and tapped screw holes that match the hinge screw holes in the door wherein the door can be treated while said substitute hinge means are mounted thereon and support the door on the door support means for hinged movement, such hinge mounting means facilitating fast painting of both sides of doors, such as cabinet doors, and without defacing original hinges.

In carrying out the objects of the invention, upright support means includes at least one vertical rail thereon. Door support means are integral with vertically adjustable hanger brackets on the vertical rails. Substitute hinge means are provided on the door support means for temporarily attaching doors thereto. Doors can thus be supported in upright relation and capable of being hingedly adjusted for treating both sides thereof as well as the edges. In one important use of the present invention, hinge screw holes in the door support means can be provided that match the pattern of hinge screw holes in the door to be treated and then substitute hinges can be applied that have screw holes also matching the hinge screw holes in the door to be treated. The door can then be supported and treated with the substitute hinges supporting it for hinged movement and a capability of being treated on both sides thereof. The original hinges thus remain on the cabinet or other structure and the door can be treated such as painting without fear of marring said original hinges.

The invention will be better understood and additional objects and advantages will become apparent from the following description taken in connection with the accompanying drawing.

DETAILED DESCRIPTION OF A PREFERRED EMBODIMENT

With particular reference to the drawings, the holder of the invention comprises upright support 10 means including two or more laterally extending arms 12 in an X shape and integral end vertical rails 14.

Figure 2:
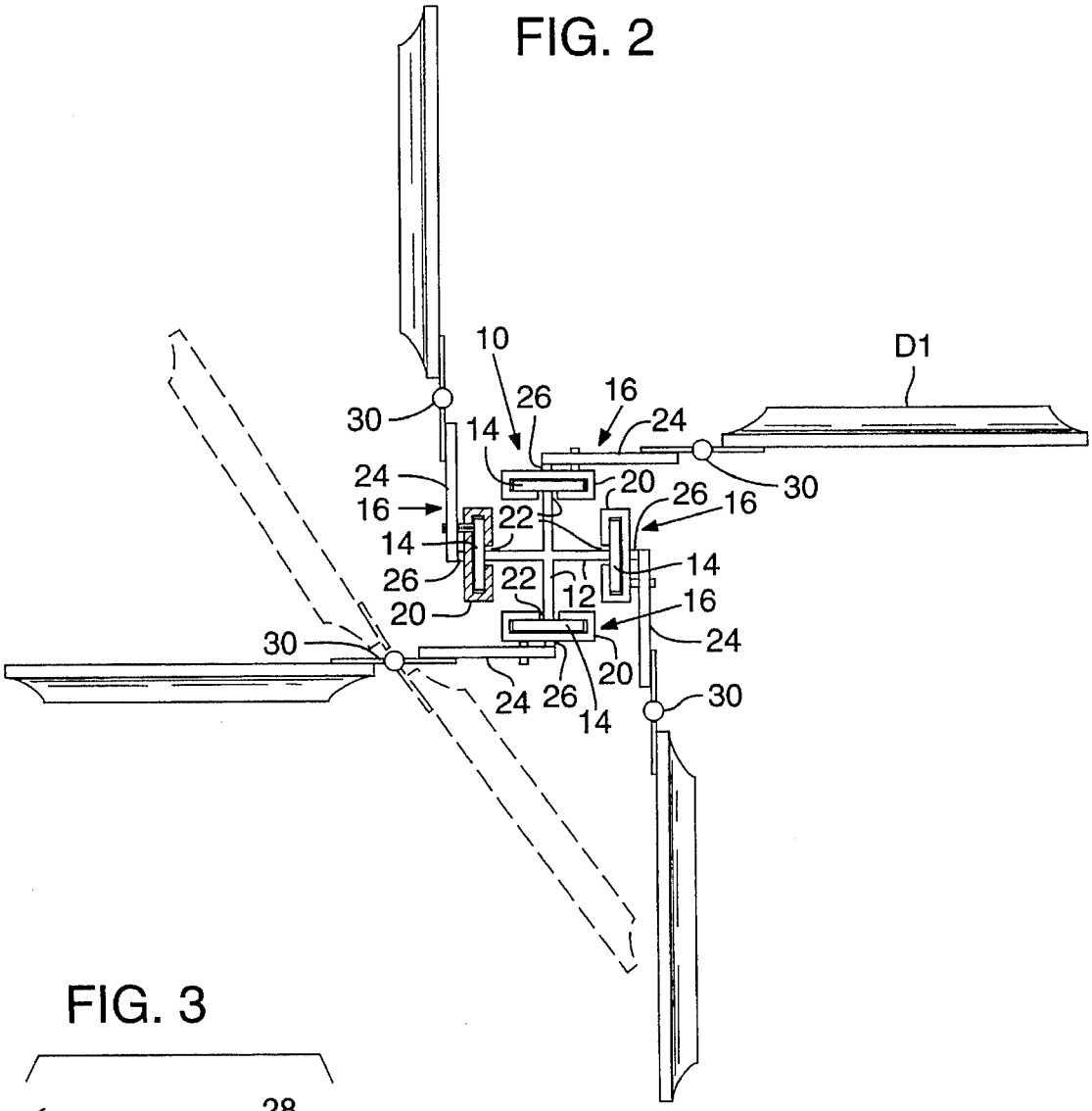
FIG. 2 is a top plan view of the holder.
Figure 3:
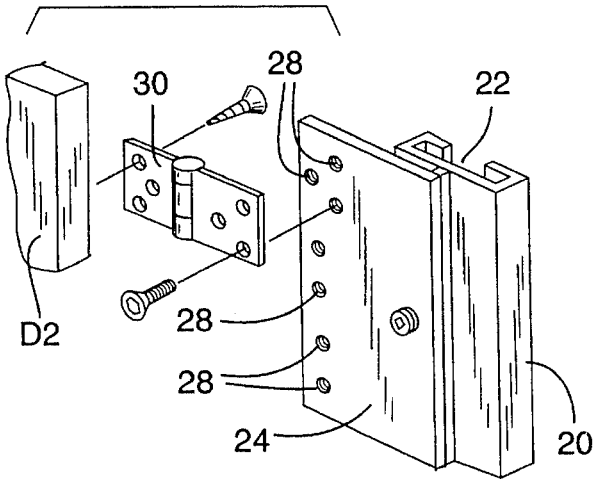
FIGS. 3 and 4 are exploded perspective views showing the holder in greater detail and also showing different sizes thereof.
Figure 4:
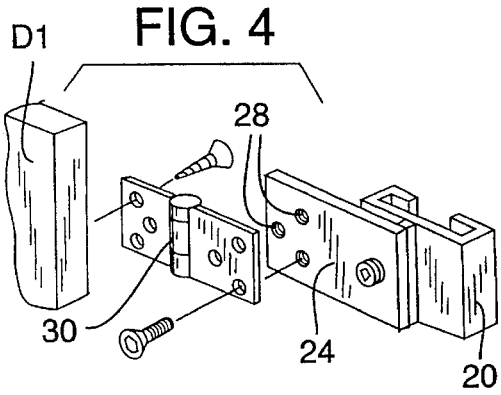

The vertical rails 14 are associated with door holder devices 16 comprising C-shaped hanger brackets 20 that have telescoping engagement with the rails. In a preferred construction, the vertical rails 14 have a rectangular or other non-round configuration in cross section, and the hanger brackets 20 are similarly shaped in their interior to slidably and non-rotatably engage the rails. As seen in FIGS. 2–4, the slots 22 in the back wall of C-shaped brackets 20 allow the brackets to be brought down over the top of the rails and removed similarly by slipping them up over the top.

Each of the hanger brackets 20 has a door support plate 24 integral therewith which is parallel with the elongated dimension of the bracket but offset therefrom a short distance by an arm 26. The brackets 20 and the door attaching plates 24 have a set screw 21 threaded therein which is capable upon tightening of locking the brackets in vertically adjusted positions.

Door support plates 24 have means 28, such as tapped holes preferably adjacent their outer free ends for receiving substitute hinges 30 capable of supporting doors to be treated while they are attached to the plates. These plates may comprise wood into which substitute hinges 30 can be secured for connection to the doors to be supported on the door mounting plate. Preferably, however, the door support plates are metal and have pre-drilled and tapped screw holes with the same pattern of screw holes as the original hinges for mounted connection of the door to the holder for instant mounting on the plates.

Figure 1:
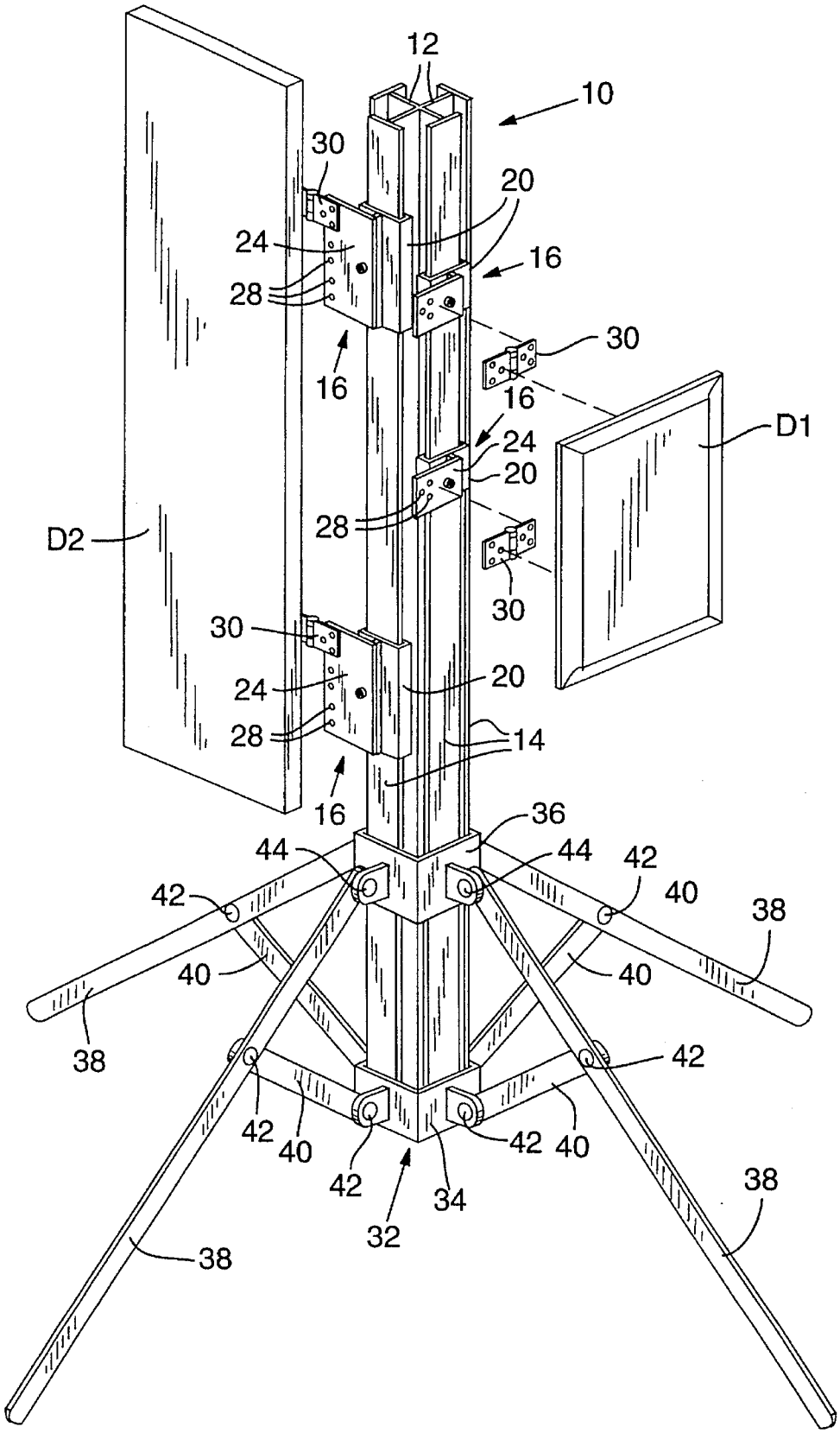
FIG. 1 is a perspective view of the holder for supporting doors to be treated according to the present invention.

The vertical dimension of the door support plates 24 may vary, as seen in FIG. 1 to accommodate selected height doors. The holder can support multiple small doors D1 on one upright 14 or if desired it can support a single larger door D2. Two or more hanger brackets may be used for the larger door. Brackets of various sizes can be substituted one for another by sliding them off the top and replacing them by another.

In addition to providing generally a hinged support of doors for painting both sides, the door support plates can have one or more sets of screw holes and substitute hinges 30 maintained in a stock supply that match these various screw holes. By using a series of screw holes in the door support plates that match hinge patterns and having a stock supply of hinges for matching the hinge pattern, the following novel process of treating hinge type doors can be carried out. It is assumed that a plurality of doors, such as kitchen cabinet doors having identical hinge patterns are to be painted. The first step is to remove the door from their hinges, namely, the original hinges will remain on the cabinet. Thereupon, substitute hinges 30 which are kept in stock can be matched to the pattern of hinges that were on the door. In turn, the door support plate has the same hinge pattern whereby the door can be mounted on the support plate with the substitute hinges. By this process, the door can be painted without concern of painting the original cabinet hinges. After the door has been painted the substitute hinges are removed and the door re-installed on its original hinges that still remain on the cabinet. Such a process saves considerable time because care does not have to be taken of the hinges during the sanding and painting. The present holder also allows both sides and edges to be painted without handling the door.

By this process, it is also feasible to provide the substitute hinges of a size smaller than the hinges remaining on the cabinets because the area of treatment around the substitute hinges will then be covered by the larger original hinges when the door is re-installed.

The upright support means 10 may be supported by a bottom stand 32 having a cup portion 34 that forms a seat for the bottom end of the stand. That is, the outer dimension around the vertical rails 14 and the interior of the cup portion 34 are such that the latter will snugly receive the upright portion. A collar 36 is slidably fitted on the standard above the cup portion and has supporting legs 38. The cup portion 34 is suspended from the legs 38 by links 40 that have pivot connections 42 with side walls of the cup portion and with the legs at an intermediate portion of the latter. The legs 38 have horizontal pivot connections 44 at their upper ends with the collar 36. The upright support means 10 can be supported on a wall or hung from the ceiling instead of using a bottom stand 32.

The sliding collar 36, the cup portion 34, and the links 40 and pivot connections 42 and 44 allow the stand to fold and unfold. In the vertical support position of the holder, the collar is raised a selected distance on the standard which pulls the legs inward to provide angled support as shown in FIG. 1. For folding the stand, the sliding collar 36 is raised to pull the legs fully inward parallel with the support means 10 which compacts the stand for shipment and storage.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A holder for supporting doors to be treated comprising:

upright support means having upper and lower ends, said upright support means including at least one vertical rail, hanger bracket means supported on said at least one vertical rail for vertical adjustment, door support means on said hanger bracket means, and hinge means on said door support means for temporarily attaching a door to be treated to said door support means wherein the door is supported in upright relation and is hingedly movable for treating both sides thereof.

2. The holder of claim 1 wherein said hanger bracket means is removably mounted at the upper end of said at least one vertical rail for substituting one of said hanger bracket means for another.

3. The holder of claim 1 including set screw means on said hanger bracket means engageable with said at least one vertical rail for adjusting the supported height of said hanger bracket means on said at least one vertical rail.

4. The holder of claim 1 wherein said hanger bracket means comprises a C-shaped socket with slidable telescoping engagement on said at least one vertical rail for said vertical adjustment.

5. The holder of claim 4 including set screw means on said hanger bracket means engageable with said at least one vertical rail for adjusting the supported height of said hanger bracket means on said at least one vertical rail.

6. A holder for supporting doors to be treated which have hinge screw holes therein for hingedly mounting the door on a door frame, comprising, upright support means having upper and lower ends, said upright support means including at least one laterally extending arm, said at least one arm terminating at an outer end thereof in a vertical rail, at least one hanger bracket on said vertical rail, door support means on said at least one hanger bracket, hinge screw holes in said door support means matching a pattern of hinge screw holes in a door that is to be treated and hingedly mounted on a door frame, and substitute hinge means having screw holes matching the hinge screw holes in the door to be treated, wherein the door can be treated with said substitute hinge means mounted thereon and supporting it on said door support means in upright relation for hinged movement and treatment on both sides of the door.

7. The holder of claim 6 including a plurality of laterally extending arms, vertical rails, hanger brackets, and door support means.

8. The holder of claim 6 wherein said at least one hanger bracket is vertically adjustable on said vertical rail.

9. The holder of claim 6 wherein said at least one hanger bracket is removably mounted at the upper end of said vertical rail for substituting hanger brackets one for another.

10. The holder of claim 6 wherein said at least one hanger bracket is vertically adjustable on said vertical rail, and set screw means on said at least one hanger bracket engageable with said vertical rail for adjusting the supported height of said at least one hanger bracket on said rail.

11. The holder of claim 6 wherein said at least one hanger bracket includes a C-shaped socket with slidable telescoping engagement on said vertical rail for vertical adjustment.

12. The holder of claim 11 including set screw means on said at least one hanger bracket engageable with said vertical rail for adjusting the supported height of said at least one hanger bracket on said vertical rail.

* * * * *